United States Patent [19]

Grant

[11] 3,982,759

[45] Sept. 28, 1976

[54] TENNIS COURT LINE MONITORING APPARATUS

[76] Inventor: Geoffrey F. Grant, 7422 Fay Ave., La Jolla, Calif. 92037

[22] Filed: Mar. 25, 1974

[21] Appl. No.: 454,136

[52] U.S. Cl. ..... 273/31; 340/323 R

[51] Int. Cl.[2] ..... A63C 19/06

[58] Field of Search..... 273/31, 102.2 R, 102.2 S; 340/384, 373, 365 G, 365 C, 361, 323, 258 C, 285; 350/284, 285, 286; 328/5; 307/116; 317/DIG. 2; 200/DIG. 1

[56] References Cited

UNITED STATES PATENTS

| | | | |
|---|---|---|---|
| 2,709,592 | 5/1955 | McAvoy | 273/102.2 A |
| 3,341,204 | 9/1967 | McDonnold | 273/102.2 A |
| 3,415,517 | 12/1968 | Krist | 273/29 R X |
| 3,492,440 | 1/1970 | Cerbone et al. | 200/DIG. 1 X |
| 3,774,194 | 11/1973 | Jokay | 272/3 X |
| 3,810,148 | 5/1974 | Karsten | 273/29 R X |

*Primary Examiner*—Richard J. Apley
*Assistant Examiner*—T. Brown
*Attorney, Agent, or Firm*—Fitch, Even, Tabin & Luedeka

[57] ABSTRACT

A line monitoring apparatus is disclosed which is particularly adapted for use in determining whether a ball lands inside or outside of an area having a premarked boundary, such as a line on a tennis court. The apparatus incorporates electrical circuitry which distinguishes between a player's foot or a ball activating the switching means monitoring so that a player cannot activate an audio or visual indicator. An embodiment of the system includes pressure operated switching means for monitoring the boundary, as well as a service foot fault detector.

13 Claims, 12 Drawing Figures

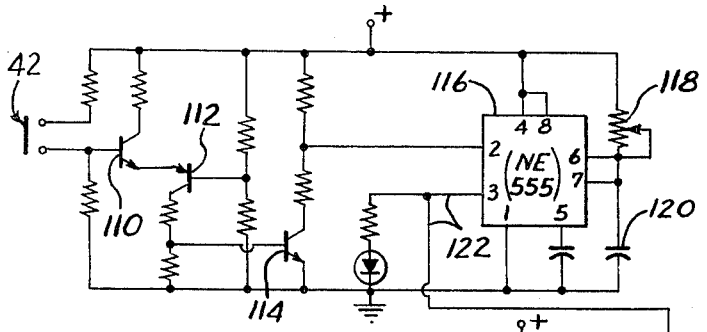
FIG.7
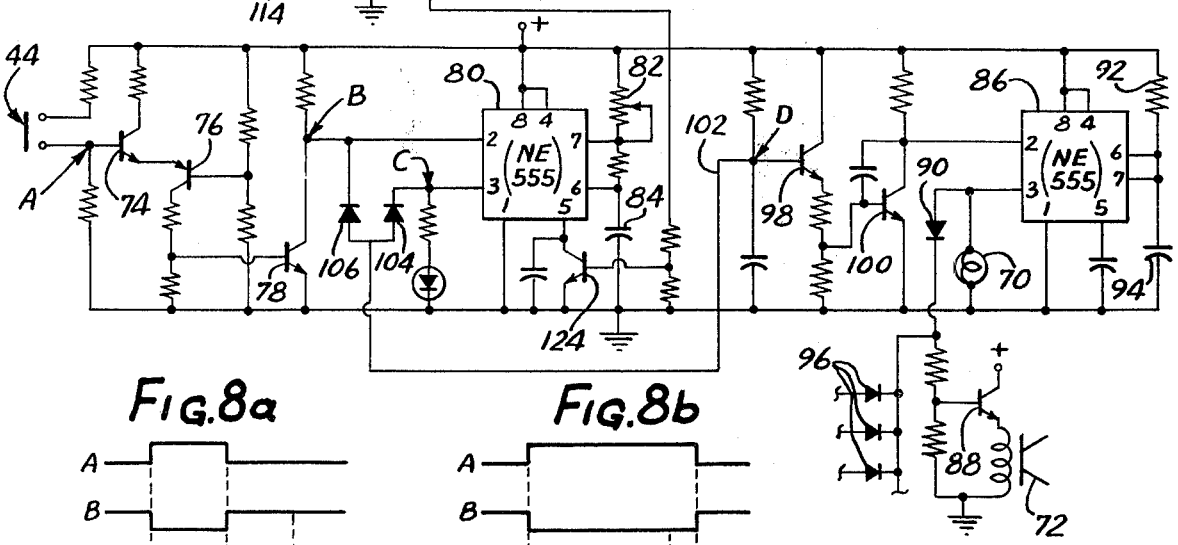
FIG.8a
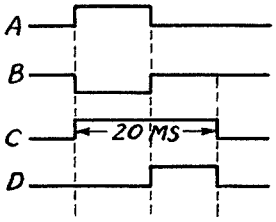
FIG.8b
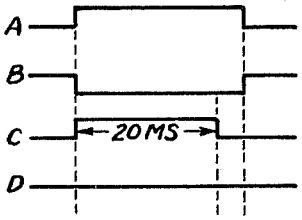
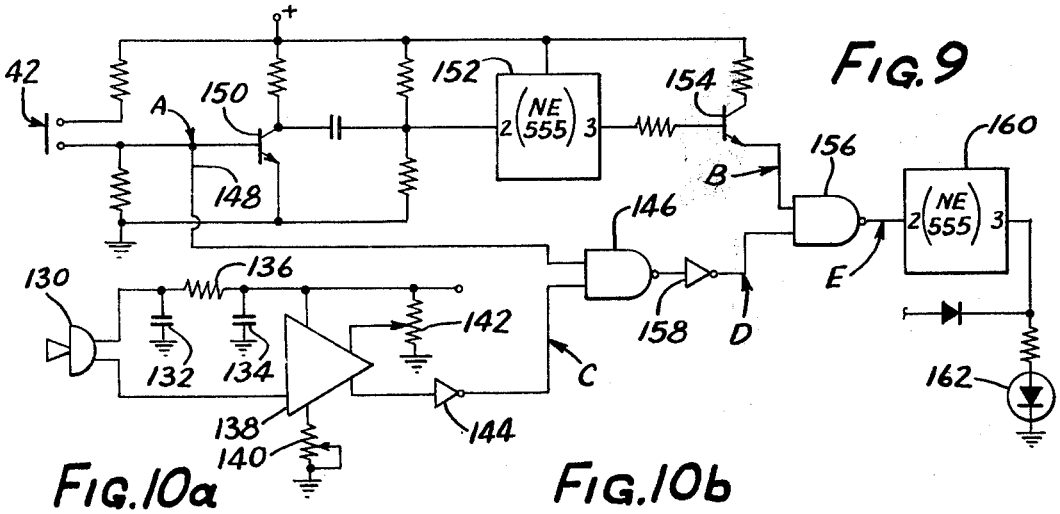
FIG.9
FIG.10a
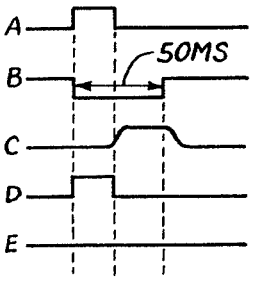
FIG.10b
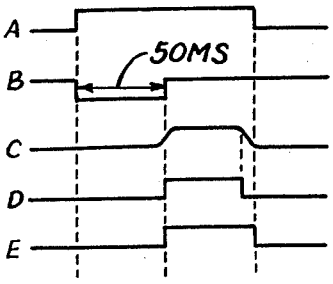

TENNIS COURT LINE MONITORING APPARATUS

The present invention generally relates to monitoring or detecting apparatus and to competitive games such as tennis and the like. More specifically, the invention relates to apparatus for monitoring a boundary and for detecting whether a ball lands on one or the other side of a boundary.

The continuing increase in the popularity of the game of tennis has, among other things, resulted in a greater number of professional as well as amateur tournaments, with the professional tournaments having substantial prize money for the players. This, coupled with the increased television exposure of the important tennis tournaments that are held within the United States and elsewhere, has focused attention to a problem that has been associated with the game of tennis, since its inception, i.e., the judging of a ball landing in or out of the court lines during play. Since competition at the highest levels of amateur and professional play is often quite close, it is not inconceivable, but quite possible in many instances, that a tennis match can be effectively determined by the accuracy of a single call or decision at a critical moment in the match. The accuracy of such a critical decision may affect the disposition of many thousands of dollars in a professional tournament and points up the need for apparatus that would effectively aid a linesman or judge in determining whether a ball was in or out of play. The fact that the judgement of the linesman concerning the point of contact of a ball relative to a line is subject of human error in that the accuracy of the decisions are at least partially dependent upon his attention span or concentration. It is also apparent that the limits of human resolution may also be reached when it is considered that the point of contact of a ball may often be less than ½ inch from the line, and the linesman may be viewing this from a distance of 30 feet or more, while the ball may be traveling in excess of 100 mph. With this degree of resolution required, it should be understandable that a fleeting lack of concentration may result in an incorrect decision vis-a-vis the ball landing "in" or "out" of bounds, even if the linesman is capable of excluding all external distractions. Even with keen concentration at the time, a linesman may not be able to accurately judge whether a ball is in or out if it is a very close call or it is a very hard, fast shot that is also reasonably close to being out of bounds.

Accordingly, it is an object of the present invention to provide an improved apparatus that will assist a linesman in determining the point of contact of a ball relative to a boundary.

Another object of the present invention is to provide such an improved apparatus that is also capable of determining whether a foot fault has been made during service by a tennis player.

A more detailed object of the present invention is to provide an improved apparatus for determining whether a ball lands on one side or the other of a boundary, wherein the apparatus can distinguish between a ball and the foot of a player.

Other objects and advantages will become apparent upon reading the following detailed description, while referring to the attached drawings, in which:

FIG. 3 is a cross sectional view taken along the line 3—3 of FIG. 1 and particularly illustrating a pressure switch means that may be used to monitor a line of a tennis court or the like;

FIG. 4 is a schematic illustration of a separate embodiment of the present invention which utilizes a plurality of light beams for monitoring a line of a tennis court or the like;

FIG. 7 is an electrical schematic diagram of circuitry embodying the present invention;

FIGS. 8*a* and 8*b* are electrical timing diagrams illustrating the operation of the circuit shown in FIG. 7;

FIG. 9 is an electrical schematic diagram of circuitry associated with the service foot fault detector portion of the present invention; and, FIGS. 10*a* and 10*b* illustrate electrical timing diagrams illustrating the operation of the circuit shown in FIG. 9.

Figure 1:
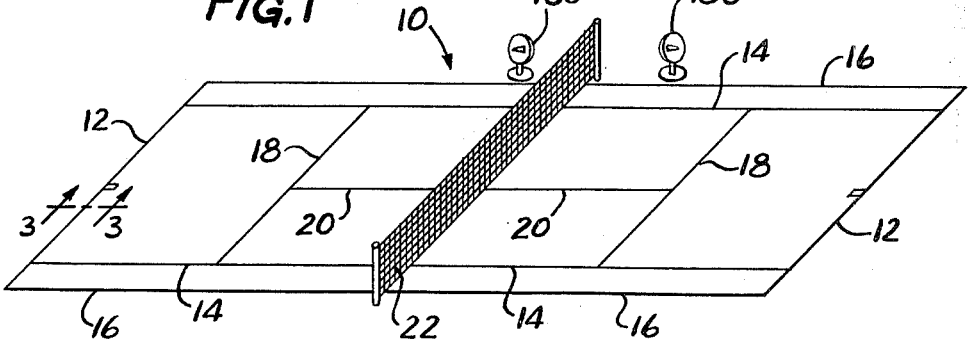
FIG. 1 is a perspective view of a tennis court and illustrating portions of the present invention.

Turning now to the drawings and particularly FIG. 1, there is shown a perspective view of a tennis court, indicated generally at 10, and having base lines 12, singles play side lines 14, doubles play side lines 16, as well as service lines 18, 20 and a net 22. As is well known, the boundary of a tennis court during singles play is determined by the base lines 12 and the side lines 14, whereas doubles play has a wider court whose boundaries are determined by the base lines 12 and the side lines 16.

Broadly stated, the present invention comprises apparatus that monitors the lines of the tennis court and provides a visual and/or audio indication concerning the point of contact by the ball during play. More specifically, the apparatus monitors the court adjacent the side, base and service lines to determine the point of contact of the tennis ball to aid a linesman in making a decision during play by providing an indication when a ball lands out of bounds provided that it lands sufficiently close to the line to activate the apparatus. The present invention utilizes switching means associated with each of the court lines that is to be monitored (with a greater or lesser number of circuits being utilized depending upon the particular arrangement being used). Virtually all of the lines of the court would preferably be monitored if both singles and doubles matches were occurring and if the service lines of the court were being monitored. It is contemplated that an effective apparatus would monitor at least the base lines 12 and side lines 14 or 16, since they define the "in bounds" area of the court. To aid the linesman in monitoring the lines and to provide an indication that a ball has gone out of bounds, a control panel, indicated generally at 26 in FIG. 2, preferably of a relatively small size that is portable and capable of being mounted on or near the umpire's chair. The control panel may be provided with the outline of the tennis court on the front thereof being illustrated by the lines 12' through 20'. Each of these lines is preferably provided with an indicating lamp or the like adjacent the front surface of the control panel 26. The front surface of the control panel may be provided with a glass or plastic surface material having transparent or translucent lines so that when the apparatus detects a ball landing out of bounds near one of the lines, for example, a base line 12, then the light associated with the line 12' on the control panel would be illuminated and provide a visual indication to the linesman who can make a decision. The use of separate circuits for each of the base lines 12, as well as for each of the side lines 14 and 16, as well as for the other service lines, provides the linesman with an indication, for example, of whether the ball landed outside of the side line but inside of a base line and thereby more precisely defines the location of the point of contact by the ball. The control panel 26 has a multiconductor cord 28 extending to the switching circuits on the court and is preferably selfcontained, i.e., substantially all of the electrical circuitry is located in the panel. The control panel 26 also has a number of pushbutton switches 30, 32, 34 and 36 which are associated with electrical circuitry for detecting a foot fault by a player during service of the ball and for monitoring the service lines associated with quadrants Q1–Q4, all of which will be more fully described hereinafter.

It should be understood that the apparatus is intended to aid an umpire in deciding whether a ball is in or out of the playing area and is not intended to be a substitute for an umpire, although the necessity for many linesmen may be obviated. Nor is the apparatus intended to provide any assistance in making the readily apparent or obvious decisions, i.e., those decisions which are not particularly close to a line and which usually generate little controversy. In other words, the apparatus is intended to monitor only a width including the court lines that may be from 6 to 24 inches, for example, although the distance on each side of the line that is to be monitored may be varied.

Figure 3:
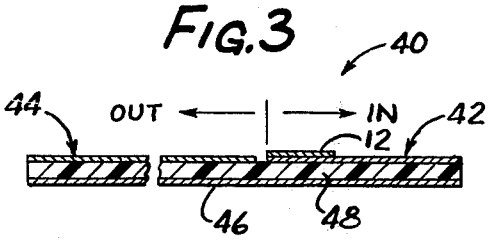

To monitor the individual lines of the tennis court, each of the lines preferably has a pressure switching means, indicated generally at 40 and shown in the cross sectional view of FIG. 3 which is applied to the court and has the base line 12 painted upon it. The switching means 40 is preferably quite thin so that it will not present a discontinuity in the playing surface. In this regard, the total thickness of the switching means 40 is preferably only a few hundredths of an inch or less. More specifically, the switch means 40 preferably has two switches 42 and 44, each having a separate upper electrically conductive layer and a common lower conductive layer 46. The upper and lower layers are preferably a plastic material that is coated with electrical conductive material and the layers are separated by an electrical insulating layer 48 that permits electrical contact between the upper and lower layers.

The material used for the insulating layer 48 separating the upper and lower conductive layers from one another is preferably a material that is resilient and compressible and which regains its original thickness so that the spacing between the upper and lower conductive layers is maintained. The material should return to its original configuration in minimum time so as to not interfere with the desired operation of electrical timing circuitry associated with the invention. In other words, if the material 48 oscillates after initial compression so as to allow repeated contact of the upper and lower layers, the operation of timing circuitry may be impaired. Moreover, it is contemplated that the switching means 40 may be of a capacitance type as opposed to the direct contact switch, i.e., the capacitance of the circuit changes as the distance between the upper and lower layers changes, rather than direct physical contact between the layers for closing the circuit. If a capacitance type of switch operation is used, minimizing the oscillation of the insulating layer 48 becomes increasingly important, particularly as the thickness of the entire composite of layers is reduced to only a few hundredths of an inch.

As best shown in the cross section of FIG. 3, the upper conductive layer of switch 42 in combination with the lower conductive layer 46 is part of one circuit which includes the base line 12 of the court. Since the rules of tennis provide that a ball hitting any part of the line is considered to be within the court, the left edge of the line 12 which is coextensive with the left edge of the upper layer 42 defines a boundary which separates the "in bounds" area from the "out of bounds" area. Thus, in the event the ball strikes the base line 12 it would close the switch 42 which would be indicative of the ball being in play or in bounds, while a ball hitting to the left of the line 12 and not striking any portion of it would actuate or close only the switch 44 as would be expected. From a practical standpoint, however, it is quite conceivable that a player hitting a hard tennis shot which would cause the tennis ball to partially strike the line 12 and close switch 42 and thereafter close the switch 44. However, the apparatus of the present invention inhibits the signal produced by the closing of the switch 44 in the event the switch 42 is closed first. In other words, if the ball only partially strikes the line 12 which would be indicative that it was in bounds, the subsequent closing of the switch 44 would not produce a visual or audio indication that the ball was out of bounds, which is the desirable result. This inhibiting capability is provided within the electrical circuitry shown in FIG. 7 which will be hereinafter described.

Figure 4:
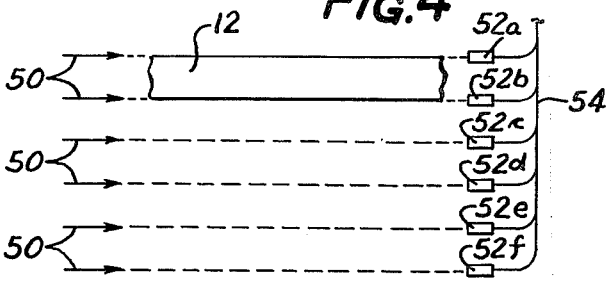
Figure 5:
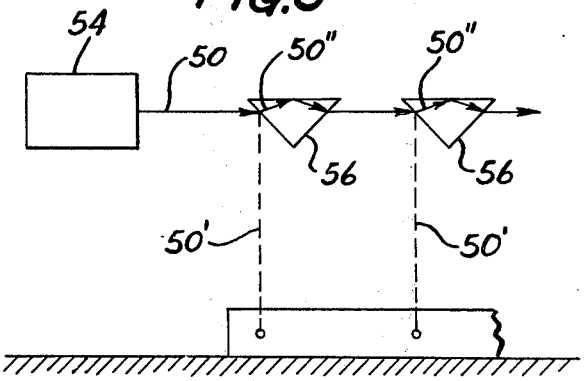
FIG. 5 is a schematic diagram of means for producing a plurality of beams, such as those shown in FIG. 4.
Figure 6:
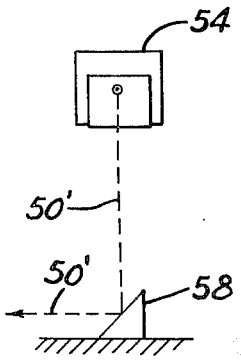
FIG. 6 is an end view of the apparatus shown in FIG. 5.

In keeping with the present invention, another embodiment of the apparatus is shown in FIGS. 4, 5 and 6 and uses light responsive switches rather than the pressure switch as shown in FIG. 3, with the light responsive switches controlling circuitry substantially similar to the schematic circuit of FIG. 7. Referring to FIG. 4, which illustrates a schematic representation of the number of light beams 50 which are positioned adjacent a boundary line such as the base line 12 and are aligned with a number of separate light detectors **52*a* through 52*f*, each of which have electrical lines 54 extending to the timing circuitry similar to the FIG. 7 schematic diagram. Each of the light detectors 54, which may be photocells, phototransistors or other light sensitive switching devices, are associated with a beam 50 that is preferably produced from a laser or a light emitting diode or the like. Since several individual light circuits are provided, each of the detectors can independently detect the presence of a tennis ball, foot or the like with the result that the immediate area near the line is monitored, thereby enabling accurately determining the point of contact of a tennis ball relative to a boundary on the court. It should be understood that the beams 50 must be located close to the court surface and it is preferred that if light emitting diodes are used, the beams should preferably be collimated by the use of a single lens system. Light emitting diodes have the advantage of increased power output compared with inexpensive gas laser beam producing apparatus. Light emitting diode lasers are also commercially available and produce coherent, low divergence infrared light which may also be collimated by a simple lens arrangement. It is preferred that the light source, whether light emitting diodes or gas laser producing apparatus or the like, be pulsed by conventional modulating circuits at a frequency of about 25 kHz to eliminate environmental light and photodetector noise. The frequency should also be outside of the normal interrupt times of a high velocity tennis ball so as to not interfere with the timing operation of the circuitry. The light responsive detectors 52 shown in FIG. 4 are intended to merely provide a schematic representation of phototransistors, photocells or the like and may have a lens positioned in front of them to focus the light of the beams 50 thereon. It should be realized that if a tennis ball interrupts the beams immediately adjacent the line 12 which are received by the detector 52***a* and 52*b*, then that detector would provide an indication that the ball has landed on the line and would be in play or in bounds, even though it may thereafter break the light circuits that are detected by the detector 52*c* and 52*d*, for example. By using an inhibiting feature similar to that described with respect to the pressure switch means 40 shown in FIG. 3, the subsequent interrupting of the light circuits outside of the line 12 would not provide a visual or audio indication that the ball was out of bounds.

In keeping with an aspect of the present invention and referring to FIGS. 5 and 6, the multiple beams 50 produced by a laser or the like may be conveniently produced from a single laser producing apparatus which would, of course, greatly reduce the expense as compared to a laser for each of the beams. Thus, a single laser producing apparatus 54 is shown generating the beam 50 which is directed to a number of 90° prisms which reflect a portion 50′ of the beam downwardly as well as refract a portion 50′ which passes to the next prism where similar refraction and reflection occurs. Thus, a single laser producing apparatus may be used to generate a plurality of individual beams 50′ which are shown to be downwardly directed and which are reflected by a 45° oriented mirror 58 to produce the horizontal beams spaced from one another as shown in FIG. 4. The mirror 58 permits the beam to be quite close to the court surface to minimize any error that might be produced as a result of a light circuit above the actual court surface. While the prisms 56 are shown in FIG. 5, partially silvered polished mirrors or polished glass or the like may also be used to provide the multiple beams 50′. Of course, the representations of FIGS. 4–6 are merely schematic representations and the detectors as well as the light source, prisms and mirrors and the like would be placed in a suitable housing to maintain the spacial and angular orientations that would be required.

In accorcance with an important aspect of the present invention, the apparatus is adapted to provide a visual and audio indication in the event a tennis ball lands out of the bounds of the playing area of the tennis court as previously described, but does not provide such an indication if the ball lands initially on the line, even if it thereafter slides out and activates the switches that normally indicate the ball is out of bounds. Additionally, the apparatus is adapted to distinguish between a player's foot from closing either of the pressure switches 42 or 44 (or breaking of the light circuits if the configuration of FIGS. 4–6 is used) in that a foot closing the switch 44 will not produce an out of bounds indication.

The capability of distinguishing between a tennis ball and a player's foot during operation of the apparatus is based upon the inherent differences in the time duration of the events taking place. In this connection, it should be understood that it is virtually physically impossible for a player to place and remove his foot from the court surface in a time much faster than about 50 milliseconds, whereas a tennis ball bouncing on the court is in contact with the court for only about 10 milliseconds. Thus, by utilizing timing circuitry that disregards a signal of a duration approaching 50 milliseconds effectively distinguishes between a signal being produced by a ball as compared to a player's foot. Thus, even though a player running on the court may step on the lines being monitored, the apparatus will not provide either a visual or audio indication of a ball being out of bounds even though the switches monitoring the lines may be closed when they are stepped on. The use of timing circuits to distinguish between these two types of events has the advantage in that the sensitivity of the switches may be optimized without regard to the amount of pressure or impulse or weight or the like and is operated in response to the duration of the event causing the switch to be activated. However, it should be understood that when a player is standing on a line which would activate the switching means that monitors such a line, the hitting of the line by a ball would not be detected, since the activation of the switching means is identical whether a ball or foot causes it. However, by installing separate switching circuits of a suitable length along a single court line so that a ball would normally activate a different switch than the player's foot, this apparent disadvantage can be substantially eliminated.

To provide the visual and audio indications that a ball has landed out of the bounds of the playing court, i.e., beyond the side or base lines of the court, the apparatus incorporates electrical timing circuitry which is shown in the schematic diagram of FIG. 7 with the electrical waveforms of FIGS. 8*a* and 8*b* illustrating the operation of the circuit. As shown in FIG. 7, the pressure switches 42 and 44 are normally open and are adapted to energize circuitry associated therewith when they are closed. Broadly stated, the circuitry illuminates a lamp 70 and energizes a buzzer 72 if the switch 44 is closed without the switch 42 having been closed, and provided that the duration of the closure of the switch 44 fails to exceed a predetermined time, such as 20 milliseconds, which is somewhat longer than the average time duration produced by a tennis ball during contact and approximately one half the minimum time duration that can be produced by a player closing the switch with his foot.

With respect to the operation of the circuit shown in FIG. 7 and assuming a ball lands outside the base line 12 so that only the switch 44 is closed, an input pulse of about 10 milliseconds duration is produced at point A (shown as waveform A in FIG. 8*a*) which turns on transistors 74 and 76 and 78 and thereby producing a negative pulse of similar duration at point B (see waveform B in FIG. 8*a*) which is connected to the trigger pin no. 2 of a linear integrated monolithic timing circuit 80, such as a NE 555 timing circuit manufactured by the Signetics Corporation, for example. When triggered, the timer 80 produces an output pulse (at pin 3) of predetermined duration which is determined by the values of a resistor 82 and a capacitor 84. In this instance, the output pulse is preferably about 20 milliseconds with the pulse being produced when the switch 44 is closed. Another timing circuit 86, which is substantially similar to the timing circuit 80, has its output (at pin 3) connected to the indicating lamp 70 as well as to a transistor 88 through a diode 90, with the transistor 88 functioning as a switch for controlling the energization of the buzzer 72. Triggering of the input of the timer 86 will produce a positive pulse of a predetermined duration (which is similarly determined by the values of a resistor 92 and capacitor 94) which will cause the lamp 70 to be illuminated and the buzzer 72 to be sounded. It should be realized that diodes 96 are also provided in the event other circuits similar to the circuit shown activate the buzzer 72, since a circuit for each of the side and base lines is necessary if the visual indication is to be provided for each of the side and service lines shown on the control panel 26 in FIG. 2. Thus, the indicator lamp 70 is illuminated when a single circuit, such as one of the base line switches is activated.

To trigger the timer 86 which directly controls the operation of the buzzer and the indicator lamp 70, it is necessary for a negative pulse to be provided on the trigger input pin 2 thereof which occurs when transistors 98 and 100 are in conduction. The base of transistor 98 is identified as point D and a line 102 connects the base of transistor 98 to the output of timer 80 through a diode 104 as well as to its trigger input pin 2 through a diode 106. In operation, the timer 86 cannot be triggered until transistors 98 through 100 are placed into conduction which is only possible when the voltage on line 102 is high and this occurs only when neither of the two diodes 104, 106 are held at approximately ground potential. In other words, transistor 98 cannot be turned on when transistor 78 is in conduction since line 102, diode 106 and transistor 76 will provide a ground path to the base of transistor 98. Similarly, the output at pin 3 of timer 80 is normally a low or ground potential which will provide a ground path through diode 104 except during the 20 milliseconds after initial triggering. Thus, transistor 98 will only be turned on when both diodes 104 and 106 are back biased which occurs when both of the points B and C are high and this only occurs from a time subsequent to the switch 44 being opened and before 20 milliseconds has expired as illustrated in the waveforms of FIG. 8*a*.

If the duration of the closing of switch 44 exceeds 20 milliseconds, then transistor 78 will be conducting and provide a ground path through diode 106 and when the switch 44 is subsequently opened the 20 milliseconds will have expired and the timer 80 output on pin 3, i.e., point C will be low which will provide a ground path through diode 104 and will preclude transistor 98 from being energized. The longer pulse operation is shown by corresponding waveforms of FIG. 8*b* wherein the duration of the input pulse at point 8*b* exceeds the 20 milliseconds duration of the output at point C and provides a continuously low signal at point B, the base of transistor 98. From the foregoing, it should be understood that a short duration closing of the switch 44 caused by a tennis ball hitting it will produce an illumination of the lamp 70 as well as sounding of the buzzer 72. If a player merely steps on the switch 44, the time the switch is closed will exceed the 20 milliseconds period and produce no illumination of the lamp 70 or sounding of the buzzer 72, as desired.

The previous discussion concerns the bottom half of the schematic diagram of FIG. 7 which is the circuitry associated with the operation of the switch 44 and the timing circuitry involved in providing a visual or audio indication. However, as previously mentioned, the bouncing of a tennis ball on the line itself should not produce an indication by the lamp 70 or the buzzer 72, even though the ball subsequently closes switch 44 after having closed the switch 42. The closing of the switch 42 places transistors 110, 112 and 114 into conduction and provides a negative trigger pulse on pin 2 of a timer 116 which is also substantially similar to the timer 80. Triggering the timer 116 produces a positive output pulse having a duration that is determined by the values of a resistor 118 and a capacitor 120. The output (at pin 3) is connected through a line 122 to the base of a transistor 124 which has its collector connected to pin 5 of the timer 80. A positive pulse in line 122 turns on the transistor 124 and disables the timer 80 by turning off its internal comparitor. When disabled, the output (on pin 3) of the timer 80 is immediately switched back to ground or low potential before the expiration of the usual 20 milliseconds duration which results in maintaining the base of transistor 98 at a low potential and inhibits the operation of the lamp 70 or buzzer 72. From the foregoing, it should be understood that a tennis ball closing the switch 42 will inhibit the operation of the timer 80 even though the switch 44 is subsequently closed.

Turning now to another aspect of the present invention and referring to FIGS. 1, 9 10*a* and 10*b*, provision is made for detecting a foot fault by a player during service of the tennis ball. In this connection, the rules of tennis require that a player not step on the base line or on the court during service until he has struck the tennis ball with his racquet. Thus, if the ball is struck before the player touches either the court or the end line, there is no fault or penalty incurred even though his foot may be over the base line in the air prior to the ball being struck. A foot fault is also often difficult to judge because of the speed and precise timing of the service, particularly if the player is of high caliber.

In keeping with the present invention, and referring to FIGS. 1 and 9, one or more microphones 130 may be provided near the court to provide a pick-up of the sound of the tennis racquet striking the ball during service, but should not be positioned where they could create a safety hazard to the players. Broadly stated, when the apparatus is placed in the foot foul detection mode, the closing of the switch 42 prior to the microphone 130 receiving an acoustic pickup will provide an indication to the linesman that a foot fault has occurred. The circuitry shown in FIG. 9 preferably has an acoustical pickup with a filter and threshold detecting circuit so that the sound of the tennis ball being struck will be the sound that is detected. In this regard, the sound of a racquet hitting a ball is distinct, with the frequencies generally being between 400 and 1000 Hz and the duration of the sound less than about 20 milliseconds. Additionally, the microphone may have a directional preference which would further insure that extraneous noise would not interfere with the operation of the apparatus.

More specifically with respect to the operation of the foot fault circuit shown in FIG. 9, the microphone 130 picks up the sound and a filter defined by capacitors 132, 134 and a resistor 136 pass only a signal having a frequency within the range of about 400 to about 1000 Hz to an operational amplifier integrated circuit 138 having a threshold sensitivity that is adjustable by a variable resistor 140 and a gain control that may be varied by a variable resistor 142. The output of the operational amlifier 138 is fed through an inverter 144 to a NAND gate 146. The pressure switch 42 applies a positive voltage through a line 148 to the NAND gate 146 when it is closed and also places a transistor 150 into conduction which provides a negative pulse to the trigger of a timer 152, the output of which appears at pin 3 in the form of a positive pulse (preferably having a pulse duration of approximately 50 milliseconds) that is applied to the base of a transistor 154. Transistor 154 is thereby switched into conduction and its emittor of which is connected to another NAND gate 156. The output of NAND gate 146 is applied to an inverter 158 and thereafter to the NAND gate 156. The output of the NAND gate 156 is applied to another timer 160 which energizes a light emitting diode 162 or the like when a negative trigger pulse is applied at pin 2 of the timer. If the switch 42 is closed, a positive output will be generated by the timer 152 which will satisfy one half of the NAND gate 156, and the switch 42 also supplies a positive voltage to the NAND gate 146. If an audio output pulse from the operational amplifier 138 reaches the NAND gate 146 during the time the switch 42 is closed, then NAND gate 146 is satisfied and would produce a positive pulse to the lower half of the NAND gate 156 which will result in triggering of the timer 160.

Thus, standing on the base line or triggering switch 42 for a longer time than 50 milliseconds while simultaneously receiving an audio output produced by striking the ball will provide a visual display due to energization of the light emitting diode 162, which is the expected result. The waveforms of FIG. 10*a* and 10*b* respectively illustrate a closing of the switch 42 for a time shorter and longer time than 50 milliseconds with the receipt or detention of the signal produced by the racquet hitting the ball during the time that the player is standing on the switch 42. In FIG. 10*a* the timer 160 is not triggered, while FIG. 10*b* illustrates a triggering of the timer since the pulse in waveform A is of longer duration than 50 milliseconds and waveform C shows that the microphone 130 detected the ball being struck before the switch 42 was open circuited. While the electrical schematic circuit shown in FIG. 9 uses the operation amplifier 138 to differentiate the sound of the ball being struck from extraneous sounds by amplitude and threshold control in addition to the operation of the filter, it should be realized that a timer could be incorporated into the circuitry for added discrimination of the acoustical pickup to insure that the lower input signal to the NAND gate 146 occurs only when a tennis ball is struck rather than by some other extraneous sound.

Figure 2:
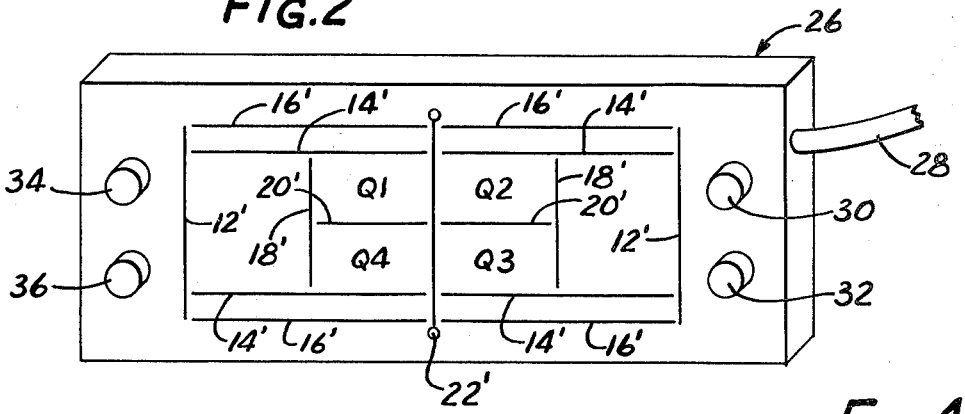
FIG. 2 is an enlarged perspective view of a small control panel that can be used to operate the apparatus of the present invention.

Referring again to the control board 26 shown in FIG. 2, the pushbuttons 30 through 36 shown at the left and right ends of the control panel are adapted to selectively energize the schematic circuit shown in FIG. 9 when depressed. Since a player alternates serving on opposite sides of the center line, the switch 30 is depressed when he serves from the right side into the opposite court marked quadrant Q4 and the switch 32 is depressed when he serves from the left side into quadrant Q1. Similarly, the pushbuttons 34 and 36 will activate the foot fault circuitry if either of them is depressed. It should be understood that only one pushbutton would be necessary if only the foot fault detection circuit shown in FIG. 9 were to be activated without regard to monitoring any of the service lines 18, 20 or the net 22. However, if a server was serving from the right side of the righ end of the court, and the pushbutton 30 was depressed, the service lines adjacent quadrant Q4 on the control panel would be activated so as to detect whether the served ball landed within the quadrant. Similarly, depressing the pushbutton 32 would activate the foot fault circuitry as well as the line monitoring circuitry associated with the lines surrounding quadrant Q1 as marked on the control panel. Moreover, the net 22 preferably has a switch that would detect whether a ball struck it during the service.

In keeping with the present invention, while the pushbuttons must be depressed to place the apparatus of the present invention in the foot fault mode of detection, the circuitry shown in FIG. 9 may conveniently produce a signal for use in switching the apparatus back into the line monitoring mode of operation. In this regard, the receipt of an acoustical signal by the microphone 130 results in a positive pulse at point C as shown by the waveform C in either FIGS. 10*a* and 10*b* and this pulse could be used to switch the foot fault circuitry off and energize the outer boundary line detection circuits associated with the base and side lines. Once the ball is served, the line monitoring circuits associated with the service lines 18, 20 and the net 22 are unnecessary, as are the side lines 14 in the event doubles play is occurring. In doubles play, the side lines 16 would be the side boundaries of the court and the lines 14 would only be used for service detection. It is also apparent that the line 20 would be used to determine a ball landing inside or outside of the service area for two adjacent quadrants and would necessarily have a slightly different configuration than the switches monitoring the other lines. In this instance, it would be necessary to have a separate circuit for the line 20 itself, as well as separate circuits for each side of the line, and the side circuits would be independently activated depending upon which of the pushbuttons were depressed. In other words, there would be a total of 3 switches for the lines 20 rather than the 2 switches 42 and 44 shown in FIG. 3 that are used for monitoring the other lines of the court.

The apparatus of the present invention is extremely useful in aiding a linesman in determining the point of contact of a tennis ball or the like striking the court near a boundary line as well as providing assistance in the determination of a foot fault by a player during service. The apparatus reliably distinguishes between a players foot and a ball activating the switching means which monitor the individual lines. This capability of disregarding the activation of the monitoring means caused by a players foot from providing a visual and/or audio indication greatly increases the credibility and effectiveness of the apparatus to a linesman using it. Moreover, the inhibiting capability also adds an important element of accuracy and reliability to the operation of the apparatus.

Although various embodiments of the invention have been illustrated and described, they will suggest a number of variations and modifications to persons skilled in the art. Accordingly, the scope of the protection to be afforded this invention should not be limited by the particular embodiments shown and described, but should be determined in terms of the definitions of the invention set forth in the appended claims, and equivalents thereof.

Various features of the invention are set forth in the following claims.

What is claimed is:

1. Apparatus adapted to detect a tennis ball landing on either a first or second side of a tennis court boundary line and providing an indication in response to the ball being detected only on said second side thereof, said apparatus comprising:

first and second switching means respectively monitoring said first and second sides of said tennis court boundary line and producing respective electrical signals in response to activation thereof;

means associated with said second switching means for measuring the time duration of said electrical signal produced thereby and for providing said indication in the event said signal is less than a predetermined time duration;

means associated with said first switching means for inhibiting said indication in response to said first switching means being activated prior to said second switching means being activated;

means for detecting the sound of a tennis ball being struck and for providing a third electrical signal in response to the detection thereof;

control means adapted to receive said electrical signal from said first switching means and to receive said third signal from said sound detecting means, said control means producing an indication in response to receiving said third signal when said first signal is being received.

2. Apparatus as defined in claim 1 wherein said tennis court boundary line has a width of a few inches, said first side includes the entire width of said tennis court line and said second side includes an area outside the tennis court playing area extending from the outer edge of said boundary line.

3. Apparatus as defined in claim 1 wherein said predetermined time duration is within the range of about 15 to about 40 milliseconds.

4. Apparatus as defined in claim 1 wherein said first and second switching means each comprise a composite of upper and lower electrically conductive layers separated by a resilient electrically insulating layer adapted to maintain the upper and lower layers normally out of contact, said composite of said layers being sufficiently thin so that the continuity of the surface to which it is applied is substantially unaffected.

5. Apparatus as defined in claim 1 wherein said control means includes means for disregarding electrical signals from said first switching means if said signals have a time duration less than a predetermined value.

6. Apparatus as defined in claim 5 wherein said time duration is within the range of about 40 to about 60 milliseconds.

7. Apparatus for detecting a tennis ball landing within a predetermined distance from at least one of the boundary lines of a tennis court, and providing an indication in response to the ball landing outside of said boundary line, said apparatus comprising:

switching means associated with said line and including at least a first switch associated with an inbounds area, said inbounds area including said boundary line, and a second switch associated with an out-of-bounds area immediately adjacent said line, so that activation of said first switch by a tennis ball provides an electrical signal signifying that said ball landed in-bounds, activation of said second switch by a tennis ball providing an electrical signal signifying said ball landed outside of said boundary line;

means for producing said indication in response to receiving an output signal from a timing circuit means; and, timing circuit means connected to said first and second switches and having an output connected to said means for providing said indication, said timing circuit means providing said output signal in response to said tennis ball activating said second switch without having activated said first switch and inhibiting said output signal in response to the activation of said first switch prior to said second switch, said timing circuit means including means for measuring the duration of the activation of said first and second switches and for preventing said output signal when the duration of said activation of said second switch exceeds said predetermined time.

8. Apparatus as defined in claim 7 wherein each of said first and second switches comprises a thin laminate applied to the surface of the tennis court, said laminate comprising an upper and lower electrically conductive layer and a resilient electrically insulating layer therebetween adapted to permit electrical contact between said upper and lower layers in response to force being applied thereto.

9. Apparatus as defined in claim 8 wherein said first and second switches have a common lower electrically conductive layer and a common electrically insulating layer, the upper electrically conductive layer of each of said switches being electrically isolated from one another so as to define separate circuits during operation.

10. Apparatus as defined in claim 7 wherein said predetermined time duration is within the range of about 15 to about 40 milliseconds.

11. Apparatus as defined in claim 7 further including control panel means adapted to provide a visual indication in response to the ball landing outside of said boundary line being monitored.

12. Apparatus as defined in claim 11 wherein said control panel includes an outline of the boundary lines of a tennis court and an indicator lamp adjacent each of the boundary lines being monitored so that lighting of a lamp adjacent one of said lines on said outline provides a visual indication that said ball was outside of the corresponding boundary line of the court.

13. Apparatus as defined in claim 7 including means for providing an audio indication in response to the ball landing outside of said boundary line being monitored.

* * * * *

UNITED STATES PATENT OFFICE
CERTIFICATE OF CORRECTION

Patent No. 3,982,759 Dated September 28, 1976

Inventor(s) Geoffrey F. Grant

It is certified that error appears in the above-identified patent and that said Letters Patent are hereby corrected as shown below:

In the Abstract, line 7, after "monitoring" insert --the boundary--.

Column 1, line 32, change "of human error" to --to human error--.

Column 1, line 47, after "or", second occurrence, insert --if--.

Column 5, line 55, change "accorcance" to --accordance--.

Column 5, line 65, after "breaking" insert --one--.

Column 6, line 57, change "A" to --A--.

Column 6, line 60, change "B" to --B--.

Column 7, line 30, change "through" to --and--.

Column 9, line 37, change "detention" to --detection--.

UNITED STATES PATENT OFFICE
CERTIFICATE OF CORRECTION

Patent No. 3,982,759 Dated September 28, 1976

Inventor(s) Geoffrey F. Grant

It is certified that error appears in the above-identified patent and that said Letters Patent are hereby corrected as shown below:

Column 10, line 22, change "and" to --or--.

Column 11, Claim 1, line 28, after "third" insert --electrical--

Column 12, Claim 7, line 10, after "signifying" insert --that--.

Signed and Sealed this

Tenth Day of May 1977

[SEAL]

*Attest:*

RUTH C. MASON
*Attesting Officer*

C. MARSHALL DANN
*Commissioner of Patents and Trademarks*